US011166606B1

(12) United States Patent
Suiter

(10) Patent No.: US 11,166,606 B1
(45) Date of Patent: Nov. 9, 2021

(54) ODOR REMOVING TOILET SEAT

(71) Applicant: Douglas M. Suiter, Hudson, WI (US)

(72) Inventor: Douglas M. Suiter, Hudson, WI (US)

( * ) Notice: Subject to any disclaimer, the term of this patent is extended or adjusted under 35 U.S.C. 154(b) by 0 days.

(21) Appl. No.: 16/837,152

(22) Filed: Apr. 1, 2020

Related U.S. Application Data

(60) Provisional application No. 62/829,981, filed on Apr. 5, 2019.

(51) Int. Cl.
*A47K 13/30* (2006.01)
*A47K 13/12* (2006.01)

(52) U.S. Cl.
CPC ..... *A47K 13/307* (2013.01); *A47K 13/12* (2013.01)

(58) Field of Classification Search
CPC ..... A47K 17/307; E03D 9/04; E03D 9/05; E03D 9/052
See application file for complete search history.

(56) References Cited

U.S. PATENT DOCUMENTS 1,972,076 A * 9/1934 Cross ..... E03D 9/05 4/217
2,124,017 A 7/1938 Vandiver
2,728,088 A * 12/1955 Gudish ..... E03D 9/052 4/217
5,079,783 A * 1/1992 Haletsky ..... A47K 13/307 4/217
6,260,215 B1 7/2001 Miller
6,449,778 B1 7/2002 Franco
6,496,986 B1 12/2002 Lumsden
6,546,567 B2 4/2003 Kuzniar
6,701,538 B2 * 3/2004 Hunnicutt, Jr. ..... A47K 13/307 4/213
7,337,476 B2 3/2008 Green
7,730,560 B2 6/2010 Markaj
D653,318 S 1/2012 Torner et al.
8,719,970 B2 5/2014 Arvizu
8,973,174 B2 3/2015 Palazzola
9,399,862 B2 7/2016 Gallardo Chaparro et al.
9,422,703 B1 8/2016 Ciotic
9,756,996 B1 9/2017 Ruiz
9,848,743 B1 * 12/2017 Shabat ..... A47K 11/10
9,924,841 B1 * 3/2018 Luquin ..... A47K 13/307
2003/0070212 A1 4/2003 Brodhead
2005/0050622 A1 * 3/2005 Kelly ..... A47K 13/307 4/217
2014/0201893 A1 * 7/2014 Cassaro ..... E03D 9/052 4/217

FOREIGN PATENT DOCUMENTS

KR 100568252 B1 * 4/2006

* cited by examiner

*Primary Examiner* — Erin Deery
(74) *Attorney, Agent, or Firm* — Cramer Patent & Design, PLLC; Aaron R. Cramer

(57) ABSTRACT

An odor eliminating toilet seat has a lumen in pneumatic communication with the interior environment of a toilet bowl via a plurality of apertures disposed about the interior edge of the toilet seat. A fan draws air in through the plurality of apertures and over a replaceable carbon filter before permitting the cleaned air to exit the back of the toilet seat.

16 Claims, 3 Drawing Sheets

ODOR REMOVING TOILET SEAT

RELATED APPLICATIONS

The present invention is a continuation of, was first described in, and claims the benefit of U.S. Provisional Application No. 62/829,981 filed Apr. 5, 2019 the entire disclosures of which are incorporated herein by reference.

FIELD OF THE INVENTION

The present invention relates generally to a toilet seat and more specifically to an odor removing toilet seat.

BACKGROUND OF THE INVENTION

The battle to keep bathrooms and public restrooms smelling clean and fresh is an everlasting one. The saturation of the market with air freshening sprays, deodorizers, and filter systems is strong evidence of this battle. However, no matter the strength of any freshener, they are no-match for the obnoxious odors from human waste during the actual use of a toilet. Room exhaust fans help somewhat in this situation with regards to preventing the odor from leaving the room but do very little to help those in the room or those who enter the room shortly thereafter. Additionally, microscopic particles of fecal matter bacteria can float in the air and can contaminate surfaces and items in the bathroom. Accordingly, there exists a need for a means by which human waste odors and associated bacteria can be removed directly from the toilet bowl and preventing such odors from saturating a bathroom or restroom. The use of the odor removing toilet seat allows for a more pleasing olfactory experience during bathroom use in a manner which is simple and effective.

SUMMARY OF THE INVENTION

In view of the foregoing references, the inventor recognized the aforementioned inherent problems and observed that there is a need for an odor removing toilet seat comprises a seat upper surface which enables a user to sit thereon, a seat lower surface and a central opening which directs a plurality of bodily waste from the user into a toilet bowl below and a rear portion of the odor removing toilet seat having a higher profile than a front portion and at least one hinge. The one hinge is located at a rear of the odor removing toilet seat and is capable of hinged attachment to a rim of a toilet bowl and protruding forward. This is done so as to vertically align the central opening of the odor removing toilet seat with the toilet bowl. The odor removing toilet seat also comprises a battery which is housed in a front center section of the odor removing toilet seat.

The odor removing toilet seat also comprises a pump housing which is sized and shaped to house a vacuum pump and a plurality of associated inlet and outlet lines, a first side of the pump housing having a first side filter housing, a second side filter housing which is located at a second side of the pump housing. Each of the first side and second side filter housings houses a scent pack, a filter, and a pre-filter. The odor removing toilet seat also comprises a sensor which is in electrical communication between the battery and the vacuum pump. The sensor is adjacent a frontmost edge of the rear portion of the odor removing toilet seat.

The odor removing toilet seat also comprises a ridge which has a configured geometry to match the upper perimeter interior edge of the rim of the toilet and to create a seal from the interior of the bowl to the environment, a pair of feet providing a standoff of the odor removing toilet seat from the rim of the toilet bowl and the ridge which has a configured geometry to match the upper perimeter interior edge of the rim of the toilet and to create a seal from the interior of the odor removing toilet bowl to the exterior environment and a plurality of vent apertures located along an inner surface of the ridge. The vent apertures are in environmental communication with the pre-filter, the pre-filter is in environmental communication with the filter, which is in environmental communication with the scent pack.

The odor removing toilet seat may be generally planar and may include a plurality of rounded inner and outer edges. The battery may be a lithium ion battery and may be recharged with an induction charging system. The first and the second side filter housings and the pump housing may be accessed by a door for replacement or maintenance.

The pre-filter may provide a way to screen or filter out entrained large particles or liquid if they are drawn through the vent apertures. The sensor may sense the user is sitting on the odor removing toilet seat when the vacuum pump is activated. The sensor may be an infrared sensor. The lid of the odor removing toilet seat may not interfere with the sensor while the vent apertures may be equidistantly spaced.

The vent apertures on the first side of the odor removing toilet seat may be in environmental communication with the pre-filter located in the first side filter housing. The of vent apertures on the second side of the odor removing toilet seat may be in environmental communication with the pre-filter located in the second side filter housing. The environmental communication may be by tubing or may be molded-in passageways. The interior of the odor removing toilet seat between the ridge, the seat upper surface, and the seat lower surface may be hollow. The scent pack may be in environmental communication with, or is an integral part of, an inlet to the vacuum pump.

The inlet may fully reside within the pump housing or traverse between the respective first or second side filter housing and the pump housing. Exiting the vacuum pump may be the outlet, which is in environmental communication with a screen located on a back wall of the rear portion of the odor removing toilet seat and in communication with the room environment the toilet and the odor removing toilet seat reside. The filter may be an activated charcoal filter.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 3:
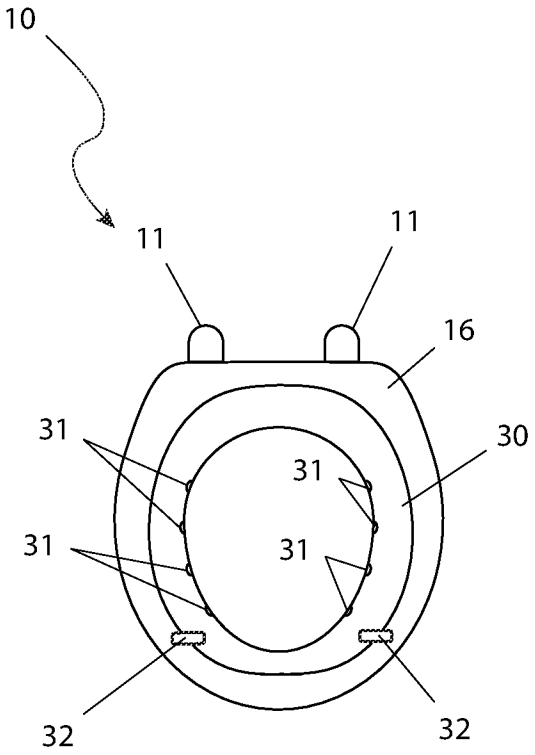
FIG. 3 is a bottom view of a of an odor removing toilet seat 10, according to a preferred embodiment of the present invention; and, FIG. 4 is an electrical block diagram of the major components as used in the odor removing toilet seat 10, according to a preferred embodiment of the present invention.

10 odor removing toilet
11 hinge

12 first side filter housing
13 pump housing
14 second side filter housing
15 seat upper surface
16 seat lower surface
20 battery
21 sensor
23 screen
25 vacuum pump
26*a* inlet
26*b* outlet
27 scent pack
28 filter
29 pre-filter
30 ridge
31 vent aperture
32 foot
60 untreated air
61 treated air
62 forced treated air
70 induction charger
75 power source
80 charging control circuit

DESCRIPTION OF THE INVENTION

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

Figure 1:
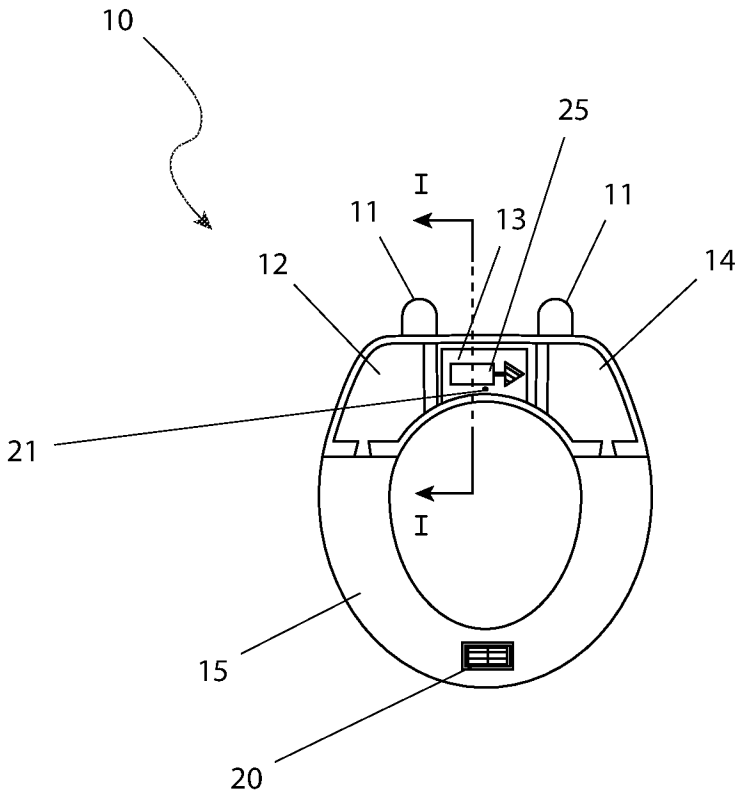
FIG. 1 is a partial cut-away top plan view of an odor removing toilet seat 10, according to a preferred embodiment of the present invention.

Referring now to FIG. 1, a top plan view of the odor removing toilet seat (herein described as the "seat") 10, with a rear portion thereof exhibiting a partially cut-away portion. The seat 10 is generally planar with rounded inner and outer edges and has a seat upper surface 15, capable of enabling a user to sit thereon, a seat lower surface 16 (best seen in FIG. 3), and a central opening in order to direct bodily waste from the user into a toilet bowl below. The rear portion of the seat 10 has a higher profile than the front portion (best seen in FIG. 2) and has at least one (1) hinge 11 located at a rear thereof, capable of hinged attachment to a rim of a toilet and protruding forward therefrom, so as to vertically align the opening of the seat 10 with the toilet bowl. A lid (not shown) can also be attached to these hinges 11 and rotate to cover the seat upper surface 15 and opening. Such a lid would have to be shaped and sized to accommodate the elevated rear portion of the seat 10. It is preferred that the hinges 11 are offset so as to enable the seat 10 and lid to pivot away from the tank o the toilet.

Figure 2:
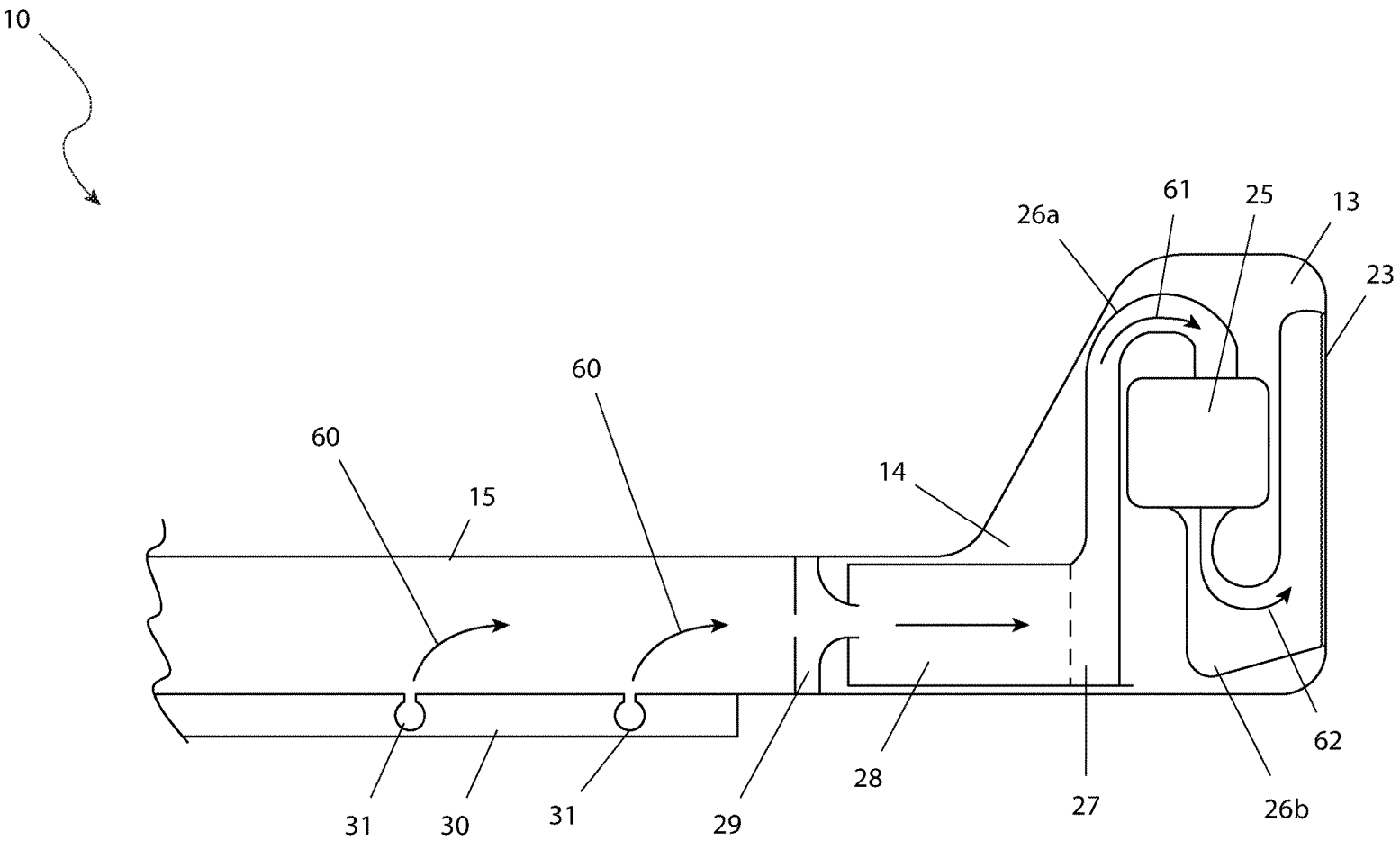
FIG. 2 is a cut-away view along the line I-I (see FIG. 1) of an odor removing toilet seat 10, according to a preferred embodiment of the present invention.

Referring now to FIGS. 1 and 2, it is shown that the front center section of the seat 10 houses a battery 20 or other similar power source. The battery 20 is preferably a lithium ion battery pack that is capable of being recharged with an induction charging system. Within the rear portion of the seat 10 and centrally located, is a pump housing 13 sized and shaped to house a vacuum pump 25 and associated inlet 26*a* and outlet 26*b* lines, which may be a molded portion of the pump housing 13 or tubing supported on unsupported therewithin. Located at a first side of the pump housing 13 is a first side filter housing 12, herein depicted as the left side of the pump housing 13. Similarly, or identically sized and shaped as the first side filter housing 12, is a second side filter housing 14 located at a second side of the pump housing 13, herein depicted as the right side thereof. Each of the first side and second side filter housings 12, 14 houses a scent pack 27, a filter 28, and a pre-filter 29. Adjacent the frontmost edge of the rear portion is a sensor 21, preferably infrared or other similar style, that is in electrical communication between the battery 20 and the vacuum pump 25. When the sensor 21 senses a user present as sitting on the seat 10, the vacuum pump 25 is activated. The lid should not interfere with the operation of the sensor 21.

Referring now to FIG. 3, there is shown on the bottom plan view of the seat 10 a seat lower surface 16, a ridge 30, and a pair of feet 31. The pair of feet 31 and ridge 30 both have a common and coextensive height. The feet 31 provide a standoff of the seat 10 from the rim of the toilet bowl and the ridge 30 has a configured geometry to match the upper perimeter interior edge of the rim of the toilet and to create a seal from the interior of the bowl to the environment. Located along an inner surface of the ridge 30 is a plurality of vent apertures 31 that may be equidistantly spaced.

Referring back to FIG. 2, it is shown that the plurality of vent apertures 31 are in environmental communication with a pre-filter 29. It is appreciated that the plurality of vent apertures 31 on the first side of the seat 10 are in environmental communication with the pre-filter 29 located in the first side filter housing 12 and similarly the plurality of vent apertures 31 on the second side of the seat 10 are in environmental communication with the pre-filter 29 located in the second side filter housing 14. The communication can be either by tubing, molded-in passageways, or the interior of the seat 10 between the ridge 30, seat upper surface 15, and seat lower surface 16 can be hollow. The pre-filter 29 is in environmental communication with a filter 28, which is in environmental communication with a scent pack 27. The scent pack 27 is in environmental communication with, or is an integral part of, the inlet 26*a* to the vacuum pump 25. The inlet 26*a* may fully reside within the pump housing 13 or traverse between the respective first or second side filter housing 12, 14 and the pump housing 13. Exiting the vacuum pump 25 is the outlet 26*b*, which is in environmental communication with a screen 23, preferably located on the back wall of the rear portion of the seat 10 and in communication with the room environment the toilet and seat 10 reside.

Both the first and second side filter housings 12, 14 and pump housing 13 may be accessed by a door (not shown) for replacement or maintenance. The pre-filter 29 provides a way to screen or filter out entrained large particles or liquid if they happen to be drawn through the vent apertures 31. The filter 28 is preferably an activated charcoal filter and the scent pack 27 is a removable feature that may be commercially produced and replaced when it is spent. The screen 23 can be a mesh or other similar material.

In a preferred method of use, when the battery 20 has a charge to enable proper usage of the device, a user places the seat 10 on the rim of the toilet bowl via the hinges 11 such that the ridge 30 provides a seal to the environment. The user then sits on the seat upper surface 15 and the sensor 21 senses the presence of the user and activates the vacuum pump 25. The vacuum pump 25 induces a vacuum, which draws in untreated air 60 from within the bowl of the toilet and through the plurality of apertures 31. The untreated air 60 passes through the pre-filter 29 and filter 28 and scent pack 27 and is transformed into treated air 61, which enters the inlet 26*a*. The vacuum pump 25 transfers the treated air 61 to the outlet 26*b*, which is now designated as forced treated air 62. The forced treated air 62 is then transferred to the room environment through the screen 23.

Figure 4:
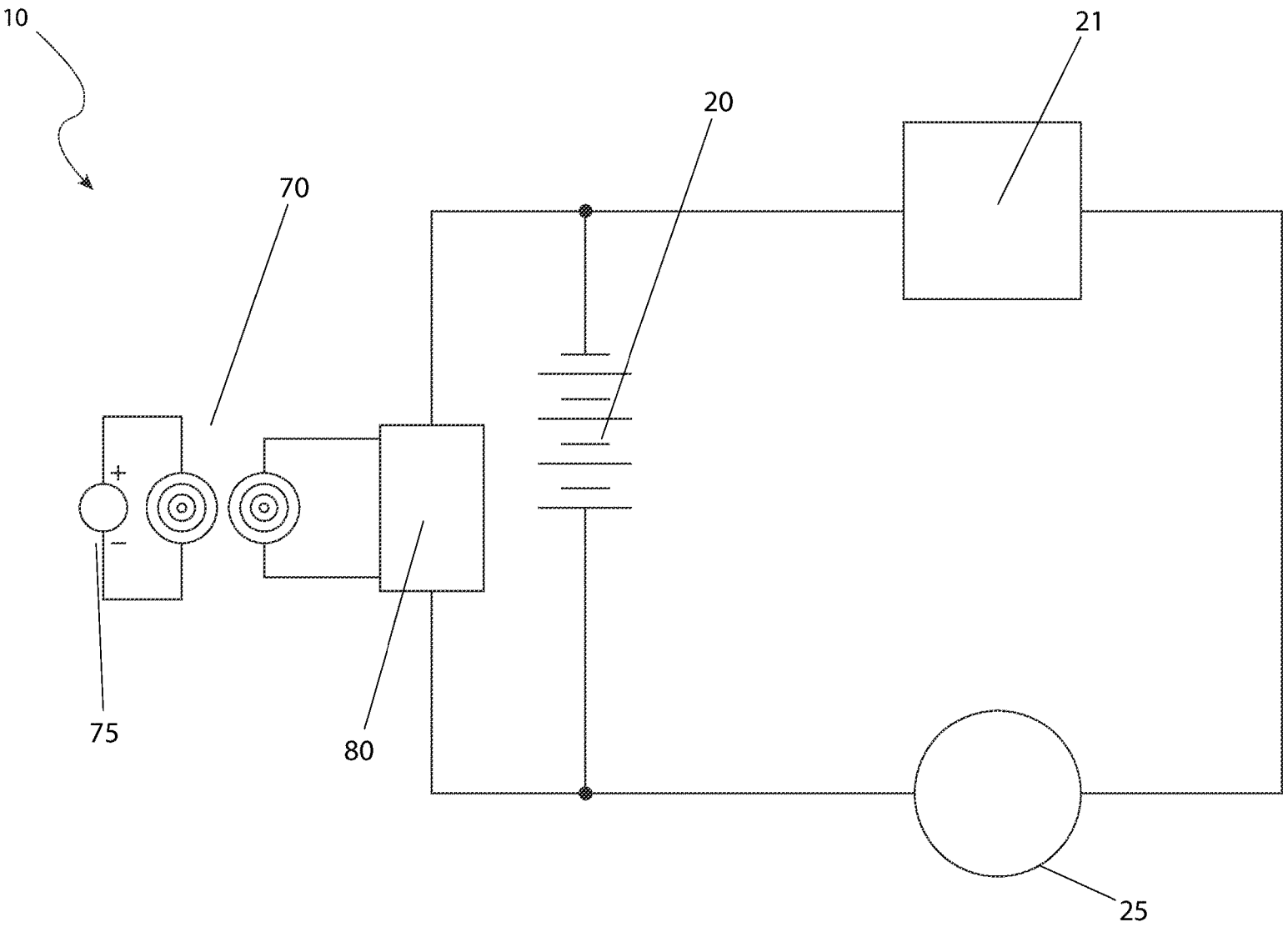

Referring now to FIG. 4, an electrical block diagram of the major components as used in the odor removing toilet seat 10, according to a preferred embodiment of the present invention is shown. The battery 20 is recharged by an induction charger 70 connected to a power source 75 such as a low voltage wall charger, USB battery pack, photovoltaic system or the like. The exact method of power generation is not intended to be a limiting factor of the present invention. The use of the induction charger 70 is intended to eliminate the use of any external physical power jacks on the toilet seat 10 and possible contamination from environmental hazards common around a toilet seat area. The induction charger would simple be set upon its mating surface whenever charging is required. Power from the induction charger 70 is routed through a charging control circuit 80 to prevent overcharging of the battery 20. Resultant power from the battery 20 is routed through the sensor 21 in a series manner and connected to the vacuum pump 25. Upon sensing user presence via the sensor 21, the circuit is closed and the vacuum pump 25 operates. In an exemplary embodiment of the seat 10, it is approximately fourteen and fifteen-sixteenths inches ($14\frac{15}{16}$ in.) in overall length and fourteen and three-eighths inches ($14\frac{3}{8}$ in.) in overall width, with the opening being approximately nine and thirteen-sixteenths inches ($9\frac{13}{16}$ in.) in length, eight and three-eighths inches ($8\frac{3}{8}$ in.) in width.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. An odor removing toilet seat, comprising:

a seat upper surface adapted to enable a user to sit thereon;

a seat lower surface and a central opening adapted to direct a plurality of bodily waste from the user into a toilet bowl below;

a rear portion of the odor removing toilet seat having a higher profile than a front portion and at least one hinge located at a rearmost portion of the seat, the rear portion of the odor removing toilet seat is capable of hinged attachment to a rim of the toilet bowl and protruding forward therefrom, so as to be adapted to vertically align the central opening of the odor removing toilet seat with the toilet bowl;

a battery housed in a front center section of the odor removing toilet seat;

a pump housing containing a vacuum pump and a plurality of associated inlet and outlet lines;

a first side of the pump housing having a first side filter housing;

a second side filter housing located at a second side of the pump housing, each of the first side and second side filter housings houses a scent pack, a filter, and a pre-filter;

a sensor in electrical communication between the battery and the vacuum pump, the sensor is adjacent a frontmost edge of the rear portion of the odor removing toilet seat;

a ridge having a configured geometry to match an upper perimeter interior edge of the rim of the toilet and to create a seal from the interior of the bowl to an exterior environment;

a pair of feet providing a standoff of the odor removing toilet seat from the rim of the toilet bowl; and a plurality of vent apertures located along an inner surface of the ridge, the plurality of vent apertures are in environmental communication with each pre-filter, each pre-filter is in environmental communication with a respective filter, which is in environmental communication with a respective scent pack;

wherein exiting the vacuum pump is an outlet, which is in environmental communication with a screen located on a back wall of the rear portion of the odor removing toilet seat and in communication with the exterior room environment in which the toilet and the odor removing toilet seat reside.

2. The odor removing toilet seat according to claim 1, wherein the odor removing toilet seat is generally planar.

3. The odor removing toilet seat according to claim 1, wherein the odor removing toilet seat includes a rounded inner edge and a rounded outer edge.

4. The odor removing toilet seat according to claim 1, wherein the battery is a lithium ion battery.

5. The odor removing toilet seat according to claim 4, wherein the lithium ion battery is recharged with an induction charging system.

6. The odor removing toilet seat according to claim 1, wherein each pre-filter provides a way to screen or filter out a plurality of entrained large particles or liquid if they are drawn through the vent apertures.

7. The odor removing toilet seat according to claim 1, wherein the sensor senses the user is sitting on the odor removing toilet seat and the vacuum pump is activated.

8. The odor removing toilet seat according to claim 7, wherein the sensor an infrared sensor.

9. The odor removing toilet seat according to claim 1, wherein a lid of the odor removing toilet seat does not interfere with the sensor.

10. The odor removing toilet seat according to claim 1, wherein the vent apertures are equidistantly spaced.

11. The odor removing toilet seat according to claim 1, wherein some of the plurality of vent apertures are located on a first side of the odor removing toilet seat and are in communication with the pre-filter on the first side filter housing.

12. The odor removing toilet seat according to claim 1, wherein some of the plurality of vent apertures are located on a second side of the odor removing toilet seat and are in communication with the pre-filter on the second side filter housing.

13. The odor removing toilet seat according to claim 1, wherein the interior of the odor removing toilet seat between the ridge, the seat upper surface, and the seat lower surface is hollow.

14. The odor removing toilet seat according to claim 1, wherein each scent pack is m environmental communication with, or is an integral part of, an inlet to the vacuum pump.

15. The odor removing toilet seat according to claim 14, wherein the inlet fully resides within the pump housing or traverse between the respective first or second side filter housing and the pump housing.

16. The odor removing toilet seat according to claim 1, wherein each filter is an activated charcoal filter.

* * * * *